US007523778B2

(12) United States Patent
Roberts et al.

(10) Patent No.: US 7,523,778 B2
(45) Date of Patent: Apr. 28, 2009

(54) DISPOSABLE CURTAINS, SYSTEMS AND METHODS TO INSTALL A DISPOSABLE CURTAIN, AND METHODS OF MANUFACTURING A DISPOSABLE CURTAIN

(75) Inventors: Timothy J. Roberts, Palatine, IL (US); Thomas J. Roberts, Elk Grove Village, IL (US); Daniel Stout, Marengo, IL (US)

(73) Assignee: Hospital Therapy Products, Wood Dale, IL (US)

( * ) Notice: Subject to any disclaimer, the term of this patent is extended or adjusted under 35 U.S.C. 154(b) by 349 days.

(21) Appl. No.: 11/141,291

(22) Filed: May 31, 2005

(65) Prior Publication Data

US 2006/0266483 A1 Nov. 30, 2006

(51) Int. Cl.
*A47H 23/00* (2006.01)

(52) U.S. Cl. ..... 160/237; 160/330

(58) Field of Classification Search ..... 160/330, 160/89, 123, 179, DIG. 6, 237; 4/558, 608; 24/716, DIG. 31, 601.8, 573.11, 582.1; 16/87.2; 206/326; 224/257, 600; 383/7, 8
See application file for complete search history.

(56) References Cited

U.S. PATENT DOCUMENTS 274,486 A * 3/1883 Griswold ..... 24/29
2,201,804 A * 5/1940 Volland ..... 160/346
2,500,074 A 3/1950 Hill
3,035,275 A * 5/1962 Strebeigh ..... 4/608
3,321,003 A * 5/1967 Boerner ..... 160/237
3,434,525 A 3/1969 Graff et al.
3,667,999 A 6/1972 Stoveken et al.
4,120,343 A 10/1978 Wilson
4,202,059 A * 5/1980 Faragher, Jr. ..... 4/608
4,269,880 A 5/1981 Nalepka
4,377,195 A * 3/1983 Weil ..... 160/237
4,501,792 A 2/1985 Holmes et al.
4,799,779 A 1/1989 Mesmer (Continued)

FOREIGN PATENT DOCUMENTS

EP 0 754 835 A3 4/1998

OTHER PUBLICATIONS

NFPA 701, *Standard Methods of Fire Tests for Flame Propagation of Textiles and Films*, 1999 Edition, NFPA.

(Continued)

*Primary Examiner*—Blair M. Johnson
(74) *Attorney, Agent, or Firm*—Hanley, Flight, & Zimmerman, LLC

(57) ABSTRACT

Disposable curtains, systems and methods to install a disposable curtain, and methods of manufacturing a disposable curtain are disclosed. A disclosed system to install a disposable curtain includes: a washable mesh upper curtain; an installation bag structured to be suspended from an installer during installation; a disposable curtain located in the installation bag; and a plurality of connectors to removably suspend the disposable curtain from the upper curtain.

11 Claims, 5 Drawing Sheets

U.S. PATENT DOCUMENTS

| | | | | |
|---|---|---|---|---|
| 4,976,301 | A * | 12/1990 | Easley et al. | 160/84.01 |
| 5,217,057 | A * | 6/1993 | Hubbard et al. | 160/345 |
| 5,231,708 | A | 8/1993 | Hansen | |
| 5,495,628 | A * | 3/1996 | Logan | 4/558 |
| 5,681,259 | A | 10/1997 | August | |
| 5,681,627 | A | 10/1997 | Mueller | |
| 6,192,965 | B1 * | 2/2001 | Hinds | 160/330 |
| 6,244,268 | B1 | 6/2001 | Annett et al. | |
| 6,474,396 | B1 * | 11/2002 | Toder | 160/237 |
| 6,546,571 | B2 * | 4/2003 | Samelson | 4/558 |
| 2004/0074613 | A1 * | 4/2004 | Junger et al. | 160/330 |
| 2005/0005504 | A1 * | 1/2005 | Munagavalasa et al. | 43/129 |
| 2007/0065049 | A1 * | 3/2007 | Alldredge-Howard et al. | 383/8 |

OTHER PUBLICATIONS

"The SaniDrape System is a Revolutionary, Easy to Use Privacy Curtain that Allows You to Safely Advance Your Infection Control Practice," www.sanidrape.com, accessed via internet on Nov. 27, 2007 (2 pages).

An Online Brochure of the SaniDrape System, Internet Web Site of The SaniDrape System, archived Nov. 27, 2007 (2 pages).

Tacy Medical, Inc., Product Description, Internet Web Site of Tacy Medical, Inc., archived Nov. 27, 2007 (1 page).

Tacy Medical, Inc., List of Products, Internet Web Site of Tacy Medical, Inc., archived Nov. 27, 2007 (2 pages).

* cited by examiner

DISPOSABLE CURTAINS, SYSTEMS AND METHODS TO INSTALL A DISPOSABLE CURTAIN, AND METHODS OF MANUFACTURING A DISPOSABLE CURTAIN

FIELD OF THE DISCLOSURE

This disclosure relates generally to privacy curtains, and, more particularly, to disposable curtains, systems and methods to install a disposable curtain, and methods of manufacturing a disposable curtain.

BACKGROUND

Hospitals have long used curtains to provide patient privacy and/or room division. These curtains are often suspended from a track on a ceiling such that they can be pulled or extended to a first desired position (e.g., around a bed) when, for example, privacy is desired and moved back to a stored position when, for example, the need for privacy is reduced.

Typically, privacy curtains include two components, namely, an upper mesh component and a lower opaque component. The upper mesh component terminates above eye level (e.g., above 6 feet) to prevent individuals from looking over the opaque portion to defeat the privacy effect. The mesh component ensures that the curtain does not substantially interfere with ceiling mounted sprinklers in the event of a fire because the water from the sprinklers can pass through the mesh. It also ensures that the curtain does not interfere with lighting or with air circulation. The opaque portion provides the desired privacy.

Hospital curtains can become soiled and/or collect bacteria, mold, and/or viruses during use. The collection of bacteria, mold, and/or viruses raises the possibility of cross-contamination, for example, from one patient to the next or from a patient to a health care provider or visitor to the hospital. Unfortunately, hospital curtains are also typically difficult to change and/or wash. Therefore, the possibility of cross-contamination due to a soiled privacy curtain that has not been changed or washed for a period of time provides an ever present health threat in the hospital setting.

For example, burn patients are particularly susceptible to infection since portion(s) of their skin have been lost due to the burn injury or removed by surgery (e.g., debridement). Privacy curtains are extensively employed in burn units. Therefore, the threat of infection from a privacy curtain is particularly high for a burn patient. However, burn patients are only an example of patients that may be infected by contact with a soiled prior art privacy curtain. The risk of cross-contamination via prior art privacy curtains extends beyond the burn unit to other places where prior art privacy curtains are employed.

DETAILED DESCRIPTION

Figure 1:
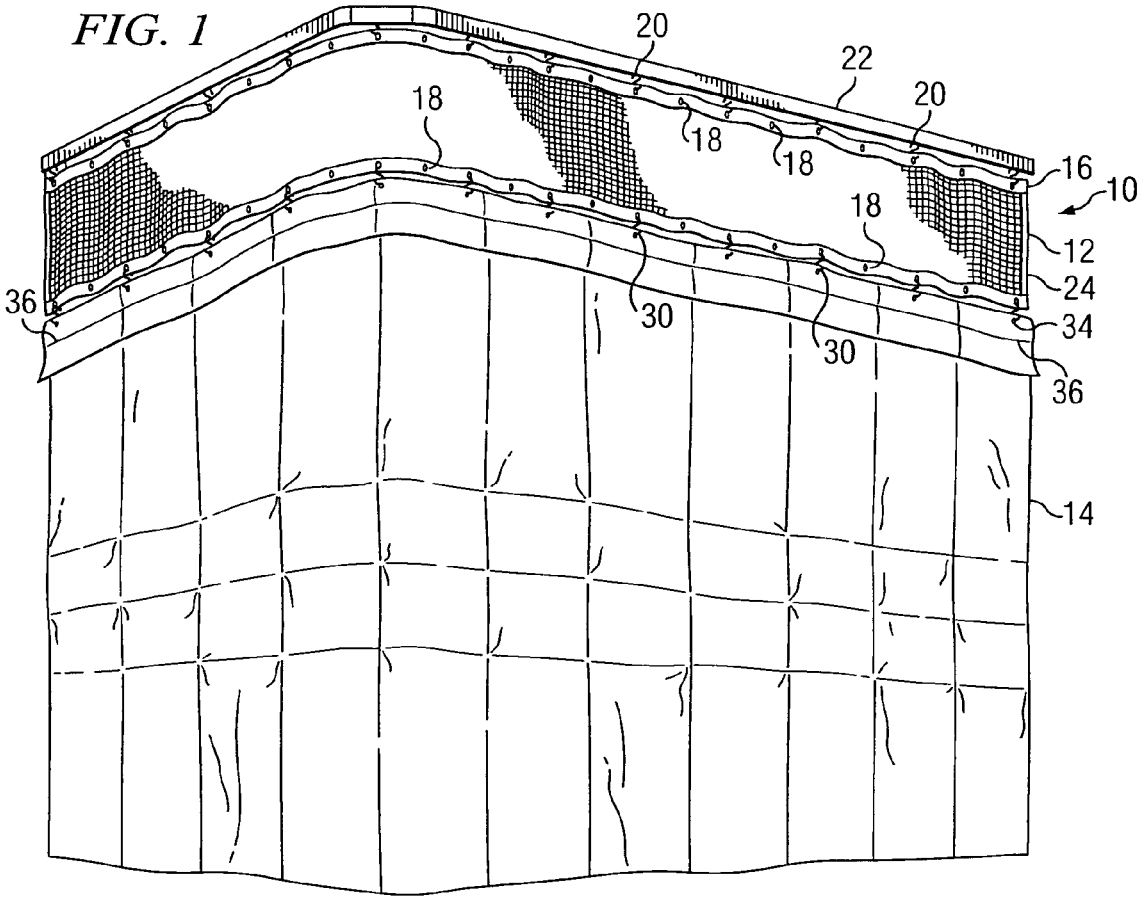
FIG. 1 is a perspective view of an example privacy curtain constructed in accordance with the teachings of the invention.

FIG. 1 is a perspective view of an example privacy curtain 10 constructed in accordance with the teachings of the invention. In the illustrated example, the curtain 10 includes an upper curtain 12 and a lower curtain 14 removably suspended from the upper curtain 12. The upper curtain 12 is preferably implemented by a mesh curtain 12 to allow for lighting, air circulation, and the operation of fire sprinklers in the event of a fire. The lower curtain 14 is preferably opaque to provide privacy when the curtain 10 is properly positioned.

The upper curtain 12 of the illustrated example is suspended from a track on a ceiling in the manner conventional in privacy curtains. In particular, the upper curtain 12 includes an upper selvage 16 defining a plurality of eyelets or grommets 18 for removably receiving mechanical fasteners 20 such as hooks that are slidably suspended in the track 22. The track 22 and the mechanical fasteners 20 are well known, conventional structures and, thus, will not be further described herein.

Figure 8:
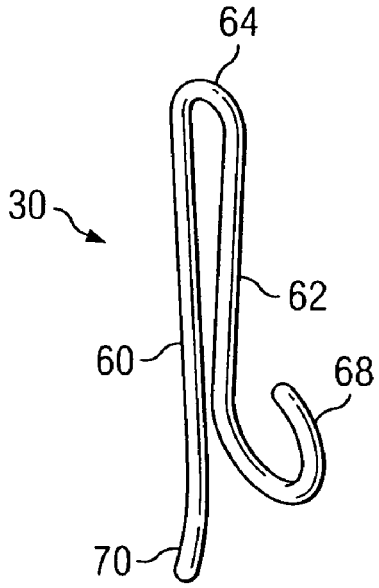
FIG. 8 is a perspective view of an example mechanical fastenerer for suspending the disposable portion of the curtain of FIG. 1 from the upper mesh curtain.
Figure 9:
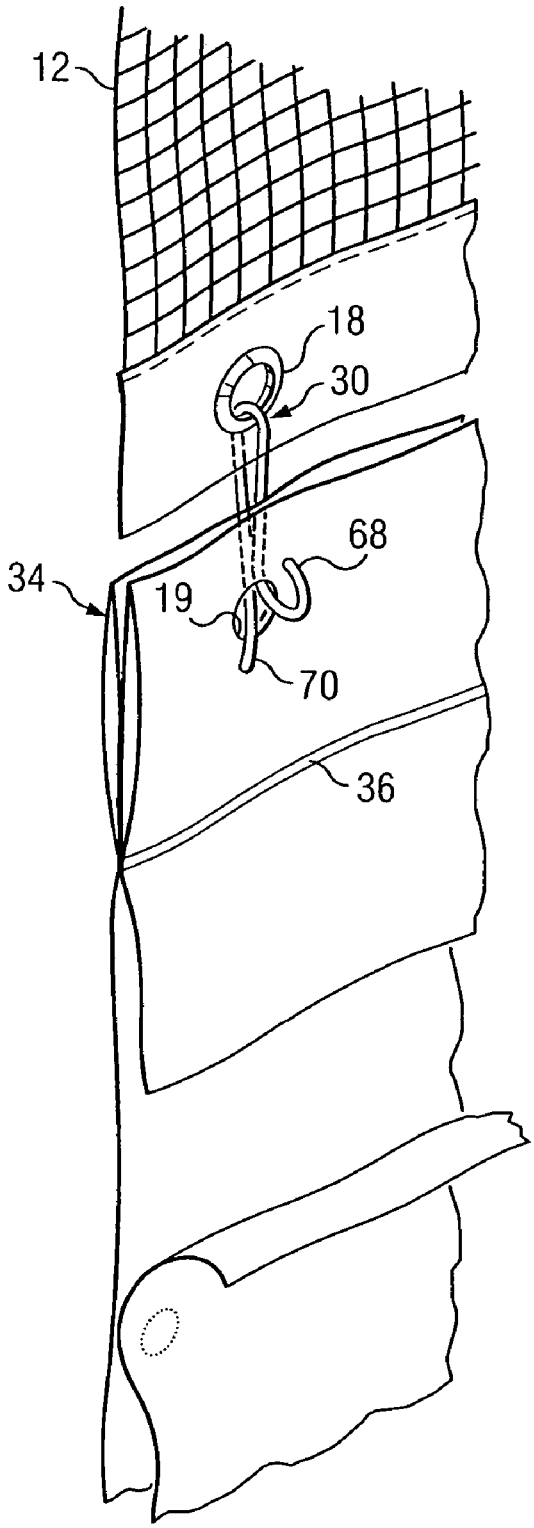
FIG. 9 is an enlarged perspective view of the mechanical fastener of FIG. 8 shown in an example locked position.

In the illustrated example, the upper curtain 12 includes a lower selvage 24. Like the upper selvage 16, the lower selvage 24 defines a plurality of eyelets or grommets 28 for removably receiving mechanical fasteners 30 such as hooks. The mechanical fasteners 30 are provided to removably suspend the lower curtain 14 from the upper curtain 12. A preferred example mechanical fastener 30 is shown in FIGS. 8-9 and is discussed further below. Preferably, the lengths of the upper curtain 12 and the lower curtain 14 are selected to suit the application. Preferably, the lengths are chosen to ensure that the mechanical fasteners 30 are suspended at a height that can be reached by a housekeeper or nurse's aide standing on the floor such that a ladder or stool is not necessary to install the lower curtain 14 on the upper curtain 12 while ensuring the lower curtain is sufficiently tall to provide privacy. In the preferred example, the height of the lower selvage 24 of the upper curtain 12 is approximately 6 to approximately 6.5 feet above the floor, although persons of ordinary skill in the art will readily appreciate that other heights may be chosen. For example, in a hospital privacy curtain context where a curtain track 22 is mounted on a nine foot ceiling, the lower curtain 14 will typically have a height of about five feet. In this example, to suspend the mechanical fasteners at a height of about 6.5 feet, the upper curtain 12 should have a height of about 2 feet, depending on the length of the mechanical fasteners 20, 30 selected.

As discussed above, conventional privacy curtains tend to become soiled and/or to collect/grow bacteria, mold, and/or viruses. To address this issue, in the illustrated example, the lower curtain 14 is a low cost, disposable curtain that can be changed as often as necessary to prevent cross-contamination. For example, a new disposable curtain 14 can be used with each new patient, thereby substantially eliminating the possibility that the disposable curtain 14 can act as a source of bacteria, mold, and/or virus transmission from person to person (e.g., from patient to patient).

Because the lower curtain 14 is designed to provide the privacy function, the upper curtain 12 is suspended near the ceiling and is, therefore, not in a position where it is likely to be contacted by a person. As a result, the upper curtain 12 does not present the cross-contamination risk of the lower curtain 14, and, thus, the upper curtain 12 need not be changed nearly as frequently as the lower curtain 14. In the preferred example shown in the drawings, the upper curtain 12 is not disposable, but instead is intended to be periodically washed and re-used.

Because the upper curtain 12 is intended for re-use and the lower curtain 14 is disposable, it may be desirable to avoid varying the height of the disposable lower curtain 14. To this end, the height of the upper curtain 12 may be varied to suit the particular application. For example, a hospital room with a 8 foot ceiling may employ an upper curtain 12 that is 2 feet in height whereas a room with a 9 foot ceiling may employ an upper curtain 12 that is 3 feet in height such that a disposable curtain 14 having a height of 5 feet could be used in either setting with only an approximately one foot gap between the floor and the lower edge of the lower curtain 14.

Although persons of ordinary skill in the art will readily appreciate that other materials can likewise be employed, in the illustrated example the upper curtain 12 is a nylon mesh that conforms to the National Fire Prevention Association (N.F.P.A.) code, code #701, standard methods of fire tests for flame propagation of textiles and films 2004, text #1, (small scale). The color, height and width of the mesh curtain 12 as well as the size of the mesh holes can be selected to meet the desired application. The mesh should be selected to be strong enough and flexible enough to be pulled open or closed. Preferably, the hole size of the mesh is 70% or higher (i.e., 70% or more of a one square foot piece of the mesh is open). The mesh may be bacteriostatic.

Although persons of ordinary skill in the art will readily appreciate that other materials may likewise be appropriate, in the illustrated example the lower curtain 14 is manufactured from a disposable plastic film (e.g., polyethylene) which includes an appropriate amount of anti block to reduce clinging and a Halogenated flamer retardant to reduce flammability. The dimensions of the lower curtain 14 (e.g., its height and width) are selected to meet the desired application. Thus, the lower curtain 14 can have any desired height or width. For example, the height of the disposable lower curtain 14 could be 5 to 10 feet and the width could be 5 to 100 feet or longer, as needed to enclose the desired area. The material and thickness of the lower curtain should be selected such that the lower curtain is sufficiently strong to permit the privacy curtain 10 to be pulled open or closed without tearing. To keep the weight of the lower curtain 14 low, the majority of the lower curtain 14 preferably comprises one layer of film.

The material chosen for the lower curtain 14 (e.g., polyethylene) should meet N.F.P.A. code #701, standard methods of fire tests for flame propagation of textiles and films 2004, text #1, (small scale). However, the film used to form the lower curtain 14 is also preferably a heat sealable or thermo plastic. These qualities (flame retardation and heat sealability) oppose one another and, thus, make material selection difficult. The illustrated example uses polyethylene with anti block and a Halogenated flame retardant to create a flame retardant, heat sealable, opaque firm. The presently preferred Halogenated flame retardant is ethylenebistetrabromophthalimide.

In order to ensure the weight of the lower curtain does not cause the mechanical fasteners 30 to rip from the lower curtain 30 during installation or use, the lower curtain 30 is provided with an upper gusset 34. In the illustrated example, the upper gusset 34 is formed by folding an upper portion of the film of the lower curtain 14 back onto itself and forming a heat seal 36 along the bottom of the gusset 34 to form an upper selvage. Thus, unlike the lower portion of the curtain 14 which, as discussed above preferably comprises one layer of film, the illustrated example gusset 34 includes multiple layers. The multiple layers of the upper gusset 34 ensures that the upper selvage of the lower curtain 14 is sufficiently strong.

In order to suspend the lower curtain 14 from the upper curtain 12, the upper selvage 34 of the lower curtain 14 defines a plurality of holes or eyelets 19 to removably receive the connectors/mechanical fasteners 30 suspended from the upper curtain 12. Preferably, the holes 19 are positioned above the longitudinal heat seal 36. The holes 19 are spaced and sized to cooperate with respective ones of the mechanical fasteners 30 to couple the upper selvage 34 of the lower curtain 14 to the lower selvage 24 of the upper curtain 12. Whereas the holes 18 of the upper curtain 12 preferably included grommets, the holes 19 of the lower curtain preferably do not include grommets but are simply punched through the film to reduce costs and facilitate manufacture of the disposable curtain 14.

The disposable curtain 14 can be quite large, depending on the application for which it is intended, and, thus, without further action, may be unwieldy during installation. In applications such as the hospital curtain example described above, it is often the case that the floor of the room where the curtain is to be suspended is soiled and/or contaminated with bacteria, mold, and/or viruses. Thus, to avoid contamination, the disposable curtain 14 must not be dragged along or placed on the floor during installation. To keep the cost of installing the disposable curtain 14 low, it is desirable to employ only one person to install the curtain 14.

Figure 2:
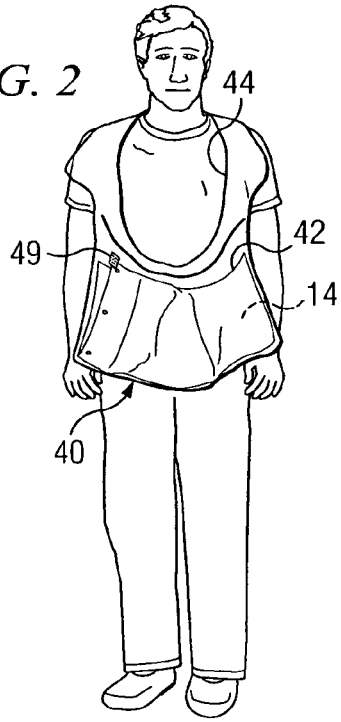
FIG. 2 is a front view of a housekeeper or nurse's aide wearing an example installation bag containing the disposable portion of the privacy curtain of FIG. 1.
Figure 3:
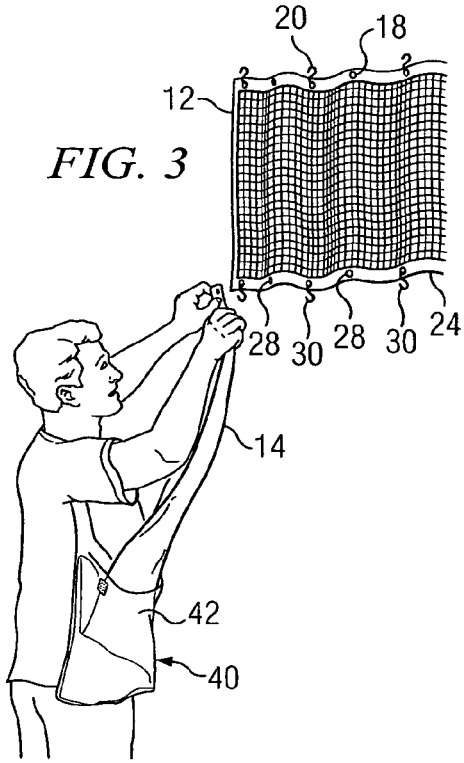
FIG. 3 is a side perspective view of the housekeeper or nurse's aide of FIG. 2 beginning the installation of the disposable portion of the example curtain of FIG. 1 on the mesh portion of the example curtain of FIG. 1.
Figure 6:
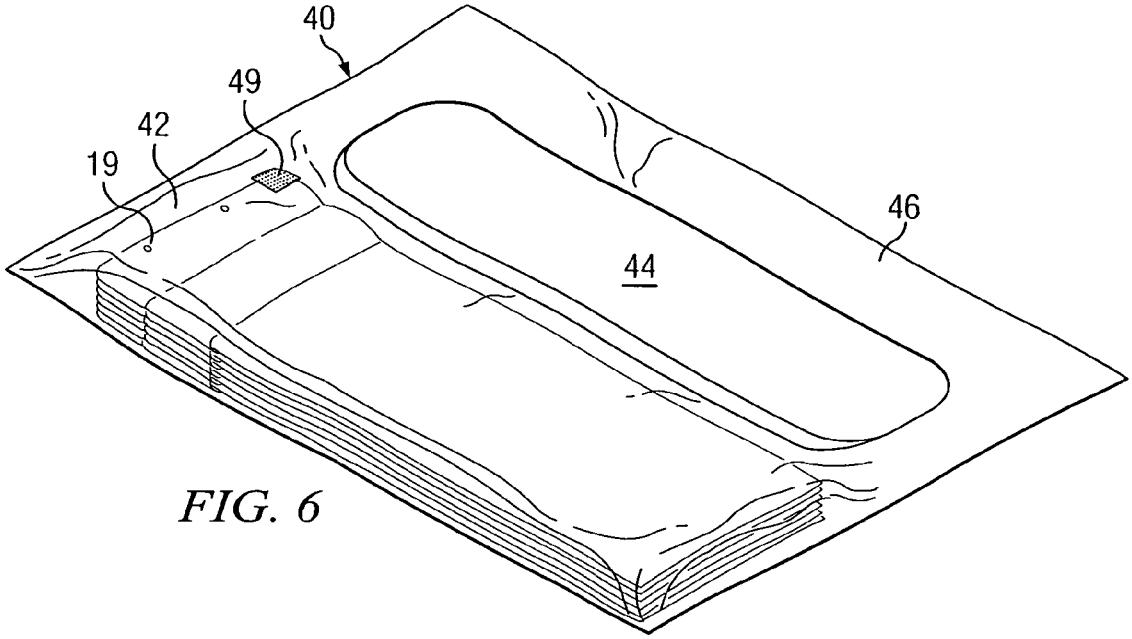
FIG. 6 is a perspective view of the example installation bag of FIG. 2 shown with an example disposable curtain disposed therein.

To enable a single housekeeper or nurse's aide to install the lower curtain 14 without bringing the disposable curtain 14 into contact with the floor, the disposable curtain 14 is provided in an installation bag 40. As shown in FIGS. 2-3, the installation bag 40 is structured to be suspended from an installer/housekeeper/nurse's aide during installation. In the illustrated example, the installation bag includes a pocket 42 to receive the disposable curtain 14 and defines a hole 44 sized to receive a portion of the installer/housekeeper/nurse's aide. As shown in FIG. 6, in the illustrated example, the hole 44 is sized to receive a head of a human installer. In particular, the hole 44 is defined by a strap 46 to suspend the bag 40 from the neck of the housekeeper or nurse's aide such that the bag 40 is worn like an apron. However, the bag 40 may alternatively be structured for suspension from one or more other body parts of the worker or from another structure such as a stand with rollers. In the illustrated example, the pocket 42 is dimensioned to receive the disposable curtain 14 such that the disposable curtain 14 is located in a generally horizontal orientation and, prior to installation, the curtain 14 is positioned across the abdomen of the installer as shown in FIG. 2. However, persons of ordinary skill in the art will appreciate that other orientations are likewise appropriate. For example, the pocket/pouch 42 can be structured to hold the curtain 14 in a generally vertical orientation which may, for instance, be generally aligned with the longitudinal axis of the installer's body.

The pocket 42 of the installation bag 40 includes an upwardly facing opening. The opening of the pocket 42 is in communication with the hole 44 to facilitate access to the curtain 14 by the installer.

In the illustrated example, the installation bag 40 is made of polyethylene, although persons of ordinary skill in the art will readily appreciate that other materials might likewise be appropriate. Similarly, although persons of ordinary skill in the art will appreciate that other sizes and dimensions could also be employed, in the illustrated example, the installation bag is approximately 24 inches tall and 32 inches wide. The pouch 42 of the illustrated bag 20 is approximately 13 inches tall and 32 inches wide. The cutout 44 of the bag 40 is approximately 6 inches tall and 28 inches long. Of course, any or all of these dimensions can be changed to meet the desired application.

Figure 7:
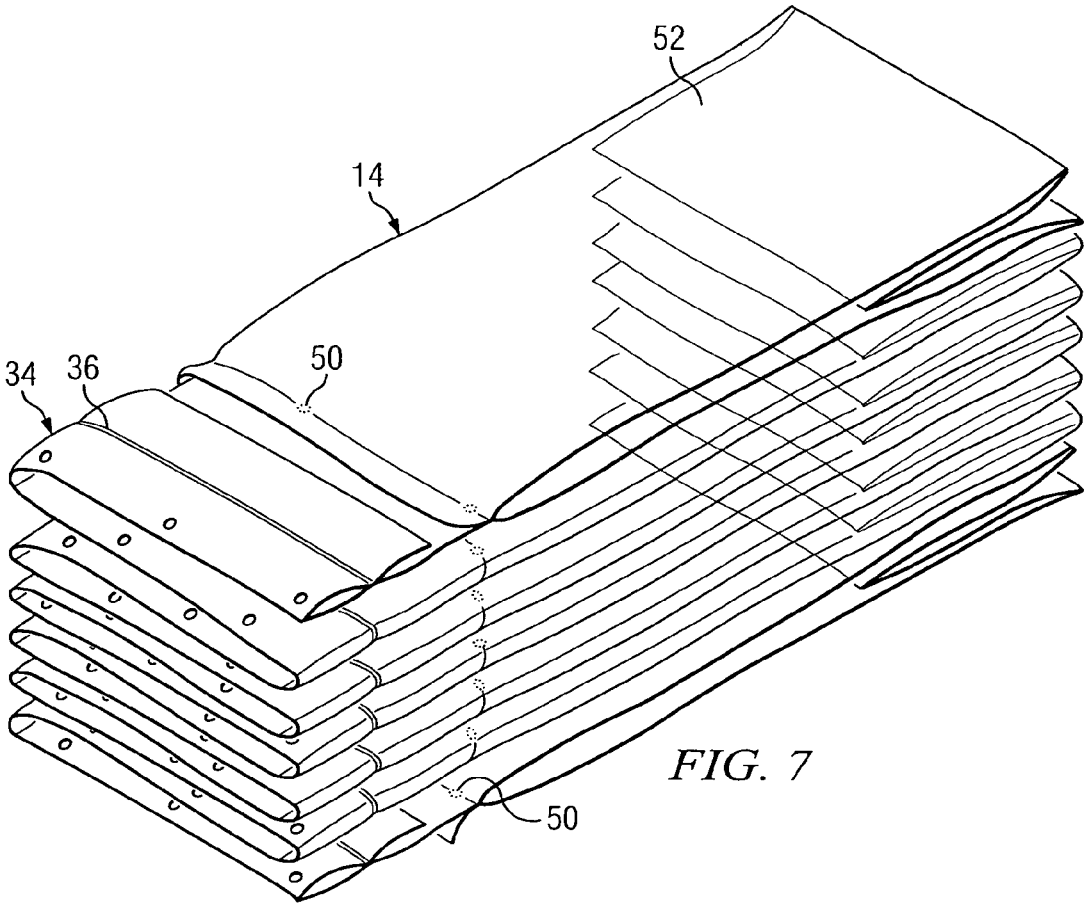
FIG. 7 is a slightly exploded, perspective view of the example disposable curtain of FIG. 6, illustrating an example manner of folding the curtain for placement in the installation bag.

In order to fit the disposable curtain 14 into the pouch 42 of the installation bag 40, the disposable curtain 14 is folded before being located in the bag 40. Preferably, the disposable curtain 14 is folded such that it does not twist within the pouch 42 during installation. In the illustrated example, this is accomplished by folding the curtain pleated style as shown in FIG. 7 before placing the curtain 14 in the bag 40. The curtain 14 is, thus, pleated such that it can be withdrawn from the installation bag 42, gusset 34 first, during installation without becoming twisted or tangled. In other words, as shown in FIG. 3, the installer can hold a portion of the upper gusset 34 with one hand and use his/her other hand to couple a mechanical fastener 30 through a hole 18 defined in the gusset 34 while the installation bag 40 supports the remainder of the curtain 14. In this way, there is no danger that the curtain 14 will contact the floor during installation and, thus, become contaminated, even though only one housekeeper or nurse's aide is performing the installation and even though the curtain 14 may be quite large (e.g., 6 feet in height by 30 feet in width). The pleated fold of the curtain 14 ensures that the curtain 14 is easily pulled from the bag 40, section by section, without twisting within the bag.

Preferably, the disposable curtain 14 is placed in the installation bag 40 at the manufacturing site such that each disposable curtain 14 is sold and shipped in its own installation bag 40. Preferably, the installation bag 40 is a single use, disposable and/or recyclable item.

To enable the installer to quickly and easily locate the upper corner of the disposable curtain 14 when the curtain 14 is in the pouch 42, as well as to hold the edge of the curtain 14 in a desired location in the bag 40 prior to installation, a locater 49 is provided. In the example of FIG. 6, the locater 49 is implemented as a releasable sticker 49 that secures a leading corner of the upper selvage 34 of the disposable curtain 14 to an inner surface of the bag 40. Of course, the sticker 49 may be attached to any other desired location of the curtain 14 and/or the installation bag 40, or may be omitted altogether, if desired. When it is desired to begin installing the curtain 14, the installer grips the portion of the curtain 14 secured to the bag 40 by the sticker 49 and then peels the sticker 49 away from at least one of the curtain 14 and the installation bag 40 to free the curtain 14 for easy installation as explained above.

To secure the disposable curtain 14 in a compact position during transportation and installation, and to provide a visual indication that the disposable curtain 14 is new, the disposable curtain 14 is provided with a plurality of tack seals 50. More specifically, in the illustrated example, the lower portion of the disposable curtain 14 is folded upward such that the lower edge of the curtain 14 is disposed below, but near, the upper gusset 34. Tack seals, (e.g., releasable heat seals), are then positioned to releasably secure the lower edge of the curtain to an intermediate portion of the curtain 14. (The intermediate portion of the curtain 14 joins the upper gusset 34 to the lower portion of the curtain 14). As a result, the disposable curtain is secured in a doubled over position.

Figure 4:
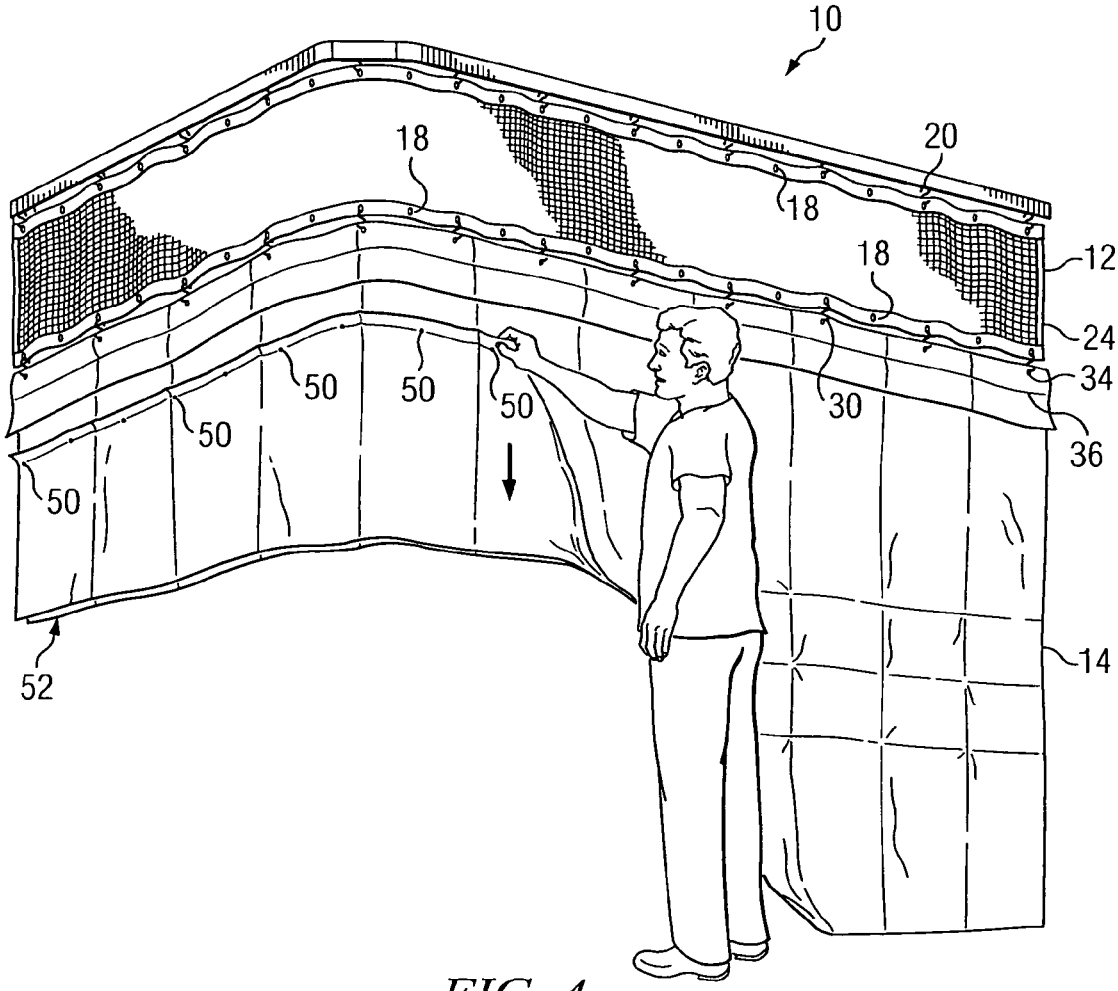
FIG. 4 is a perspective view of the housekeeper or nurse's aide of FIG. 2 releasing the lower portion of the example curtain of FIG. 1 to extend the lower, disposable portion of the curtain to its full length.

As shown in FIG. 4, when the disposable curtain 14 is first suspended from the upper curtain 12, the tack seals 50 are preferably in place such that the disposable curtain is suspended a substantial distance above the floor. In this position, the privacy function of the lower curtain 14 is largely defeated since an approximately waist high gap (e.g., 3 feet) exists between the lowest hanging portion of the privacy curtain 10 and the floor. Thus, when the privacy curtain is first installed, it is installed into a substantially non-operative state that provides a clear visual indication that the disposable curtain 14 has not yet been used and is, thus, new. This may be advantageous in that it can provide, for example, a nurse with a clear indication that the housekeeper or nurse's aide has changed the disposable curtain 14 as instructed. Thus, a hospital or other facility using the disposable curtain 14 may wish to follow a policy wherein the housekeeper or nurse's aide is required to leave the disposable curtain 14 in the inoperative position after installation. When it is desired to use the curtain 14, a nurse or other personnel can simply release the tack seals 50 (e.g., break the seals 50) and extend or permit the disposable curtain 14 to fall to its full length as shown in FIG. 4.

Figure 5A:
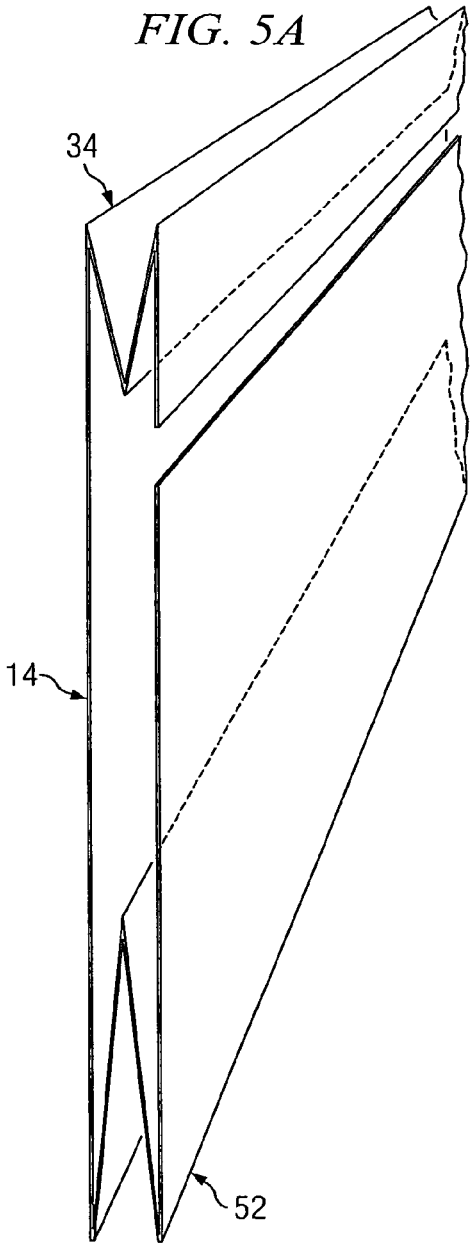
FIG. 5A is a side perspective view of the example disposable curtain of FIG. 1 shown during an example manufacturing process.
Figure 5B:
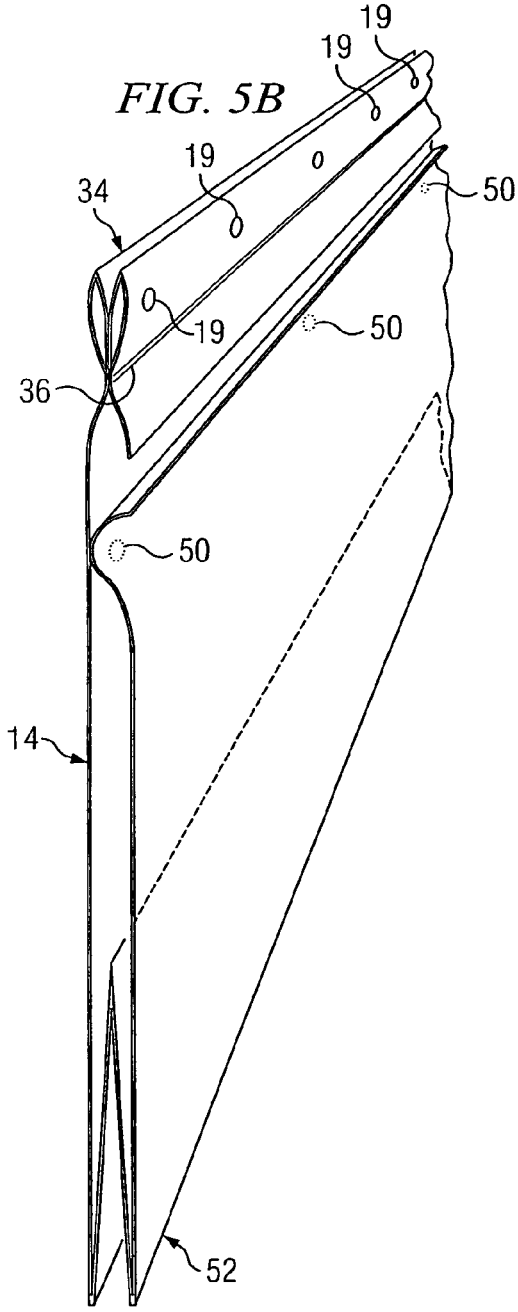
FIG. 5B is a side perspective view similar to FIG. 5A, but showing the example disposable curtain after example tack seals have been added to secure the lower portion of the disposable curtain to an intermediate portion of the disposable curtain and after the upper gusset has been heat sealed to form an upper selvage.

In addition to providing the visual indication noted above, the tack seals 50 hold the disposable curtain 14 in a folded position during installation to keep the curtain 14 from falling to its full length as explained above. To reduce the packing size of the curtain 14, the lower edge of the folded and tack sealed curtain 14 is preferably folded to form a lower gusset 52 (see FIGS. 4, 5A, 5B and 7). An example method of manufacturing the disposable curtain 14 will now be described with reference to FIGS. 5A-5B.

The manufacturing process starts by forming a loop of film having the width and height desired for the given application. (The loop can be formed by a continuous loop of material or by a suitably folded sheet of material). A portion of the material is folded to define an upper gusset 34. The upper gusset 34 is heat fused along a longitudinal seal line 36 to form an upper selvage 34. In the illustrated example, the gusset 34 is formed by four layers of material for strength. A series of eyelets or holes 19 are formed in the upper gusset 34.

If the loop of material is formed by a continuous loop, a longitudinal cut is made in one side of the loop adjacent the upper gusset 34 to define a lower edge of the curtain 14. If the loop of material is not a continuous loop, a cut is not necessary. However, it may be necessary to fold the sheet about a generally horizontal line such that the lower edge of the film is positioned adjacent the upper gusset 34. In either event, the lower edge of the curtain 14 is releasable secured to a portion of the film intermediate the upper gusset 46 and the lower edge by tack seals 50. In other words, the disposable curtain is folded and secured to itself by tack seals 50.

Preferably, the lower portion of the film opposite the upper gusset 34 is folded to form a lower gusset 52.

The disposable curtain 14 is then preferably folded along a plurality of substantially equally spaced lines which are substantially perpendicular to the upper gusset 34. Preferably, the folding about the vertical lines is done in an alternating manner such that the curtain 14 is folded in a pleated style as shown in FIG. 7. The folded curtain 14 is then placed in an installation bag 40 and the leading edge of the curtain 14 is secured within the bag 40 by a locator 49.

From the foregoing, persons of ordinary skill in the art will appreciate that methods to mount a lower curtain from an upper curtain have been provided. For example, in an illustrated method, a lower curtain 14 is connected to an upper curtain 12 such that the lower curtain 14 is suspended from the upper curtain 12 with a lower portion of the lower curtain 14 folded back on and secured to the lower curtain 14 to prevent the lower curtain 14 from extending to a full length. Subsequently, the lower portion of the curtain is released to extend the lower curtain to the full length.

In the illustrated example, the upper curtain 12 includes mechanical fasteners 30 and connecting the lower curtain 14 to the upper curtain 12 comprises securing the hooks 30 into corresponding holes 18 defined in the lower curtain 14.

A preferred example mechanical fastener 30 is shown in FIG. 8. In the example of FIG. 8, the fastener 30 includes a first leg 60 and a second leg 62. The first and second legs 60, 62 are joined at one end by a curved portion 64. The ends of the legs 60, 62 opposite the curved portion 64 are free and separated by a distance sufficient to receive a portion of the lower selvage of the upper curtain 12. In particular, the fastener 30 can be threaded through a hole 18 of the lower selvage of the upper curtain 12 with the first leg 62 on one side of the upper curtain 12 and the second leg 64 on the opposite side of the upper curtain 12. In such a position, the fastener 30 is suspended by the engagement of the curved portion 64 joining the first and second legs 62, 64 and the grommet of the hole 18 in the upper curtain 12.

The free end of the leg 62 is curled into a hook 68. The hook 68 is structured to penetrate a respective one of the holes 19 in the upper selvage 34 of the disposable curtain 14. The engagement of the hook 68 and the hole 19 is sufficient to suspend the lower curtain 14 from the upper curtain 12. However, the illustrated example fastener 30 is advantageous in that it is also structured to support a locked position in which the lower curtain 14 is held to the upper curtain 12 with even less likelihood of inadvertent separation.

An example locked position is shown in FIG. 9. In the position of FIG. 9, both the free end of the leg 62 and the hook 68 on the free end of the leg 64 extend through an opening 19 in the upper selvage 34 of the lower curtain 12. To this end, the free end of the leg 62 is implemented as an extension 70, that curves slightly outward in a direction opposite the hook 68. Thus, to secure the fastener 30 in the locked position, one would first position the hook 68 through the hole 19. Then, the portion of the curtain 14 beneath the hole 19 is pulled downward to pass the extension 70 into the hole 19 as shown in FIG. 9. Once in this position, it is nearly impossible for the lower curtain 14 to inadvertently separate from the mechanical fastener 30.

Because it takes more time to lock the mechanical fastener 30 as shown in FIG. 9 then to simply suspend the curtain from the hook 68, it may not be desirable to lock all of the mechanical fasteners 30. Instead, it may be sufficient to lock only a subset of the fasteners 30. For example, it may be desirable to lock the end fastener(s) 30 at the far left and/or right edges of the curtain 14.

The mechanical fasteners 30 of the illustrated example are manufactured of plastic. They are, thus, washable and inexpensive.

As discussed above, in some examples, a disposable installation bag 40 is used to facilitate installation of the disposable curtain 14. In some such examples connecting the lower curtain 14 to the upper curtain 12 comprises: withdrawing a portion of the lower curtain 12 from the bag 40 containing the lower curtain 14; and securing a portion of an upper gusset 46 of the lower curtain 14 to the upper curtain 12 without completely extracting the lower curtain 14 from the bag 40 until installation is at least substantially complete such that the lower curtain 14 does not contact the floor when connecting the lower curtain 14 to the upper curtain 12.

Although use of the installation bag 40 is presently preferred, replacing the installation bag with a suspender not including a pouch 42 (e.g., a belt, a strap, a harness, a loop, etc.) is also contemplated. In such an approach, the disposable curtain 14 is releasably coupled to the suspender and the suspender secures the disposable curtain 14 to the installer (e.g., about the shoulder, the waist, the neck, the wrist, the arm, etc.) or to another structure. The use of a suspender such as the installation bag 40 or one of the alternative structures mentioned above is desirable because it frees both of the installer's hands for the installation process and enables installation by a person working alone without raising the risk of contacting the floor with the disposable curtain 14.

In some examples, the lower portion of the lower curtain 14 is secured to the lower curtain 14 with a plurality of tack seals 50. In such examples, releasing the lower portion of the curtain 14 to extend the lower curtain 14 to the full length comprises releasing the tack seals 50. In such examples, connecting the lower curtain 14 to the upper curtain 12 may be performed by a first person, and releasing the lower portion of the curtain 14 to extend the lower curtain 14 to the full length may be performed by the installer or by a second person (e.g., at a later time). Connecting the lower curtain 14 to the upper curtain 12 such that the lower curtain 14 is suspended from the upper curtain 12 with the lower portion of the lower curtain 14 folded back on and secured to the lower curtain 14 to prevent the lower curtain 14 from extending to the full length provides a visual indication that the lower curtain 14 is a new lower curtain. The lower portion of the curtain 14 need not be released to extend the lower curtain 14 to the full length until a time to use the lower curtain 14 arrives.

Although it is presently preferred to secure the lower portion of the curtain 14 to itself using tack seals 50, other approaches to making the curtain 14 easy to handle during installation are contemplated. For example, the lower edge of the disposable curtain 14 may be rolled or folded (e.g., pleated) upward toward the upper selvage 34 and held in the rolled or folded position by mechanical fasteners such as ties, straps, rubber bands, or the like. The mechanical fasteners can be released to permit the curtain 14 to unroll or unfold downward to its fully extended position. If desired, the lower curtain 14 may also be folded (e.g., pleated) or rolled in a horizontal sense and/or placed in an installation bag 40.

From the foregoing, persons of ordinary skill in the art will further appreciate that systems for reducing cross-contamination via a privacy curtain have been disclosed. An illustrated example system includes a washable mesh upper curtain 12, an installation bag 40 structured to be suspended from an installer during installation; a disposable curtain 14 located in the installation bag 40; and a plurality of connectors 30 to removably suspend the disposable curtain 14 from the upper curtain 12. The disposable curtain 14 may be provided with tack seals 50 or other fasteners to hold the curtain 14 in a substantially inoperative position after installation to provide a visual indication that the disposable curtain 14 is new.

The system may assist in reducing cross-contamination in, for example, a hospital environment in that the curtain can be easily, cleanly and cost-effectively changed at frequent intervals. For example, the disposable curtain 14 can be changed after performance of certain medical procedures, after patient discharge, after predetermined lengths of use (e.g., one day, one week, etc.), or after any other desired event(s).

Although the above examples have focused primarily on medical applications, persons of ordinary skill in the art will readily appreciate that the disclosed systems, methods and/or curtains can be used in other contexts. For example, the disposable curtains, methods, and/or systems disclosed herein can be used to provide shower curtains and/or privacy barriers in home, medical, nursing home, or other settings. In the medical context, the disposable curtains, methods, and/or systems disclosed herein can be used to provide shower curtains and/or privacy barriers in treatment rooms or patient rooms.

Further, although the above described examples have employed the disposable curtain in place of the permanent curtains conventionally employed in hospital settings, persons of ordinary skill in the art will readily appreciate that the disposable curtain 14 could alternatively be used as a liner for the conventional curtain. In such approaches one or more disposable curtains 14 could be hung adjacent one or both sides of the permanent curtain. The disposable curtain 14 could be hung from the permanent curtain in these applications. In such instances, if the permanent curtain is opaque, the disposable curtain need not be opaque. Further, if desired, the disposable curtain 14 may be hung on one side of the permanent curtain and wrapped (and possibly secured) around one or both side (vertical) edges of the permanent curtain such that the disposable curtain 14 covers the edge(s) of the permanent curtain as well as, for example, the side of the permanent curtain facing the patient. Covering the edge(s) in this manner ensures that the permanent curtain is not contacted by health care workers, etc. when the curtain is drawn between its open and closed positions.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method to mount a lower curtain from an upper curtain comprising:

connecting the lower curtain to the upper curtain such that the lower curtain is suspended from the upper curtain with a lower portion of the lower curtain folded back on and secured to the lower curtain with first fasteners to prevent the lower curtain from extending to a full length; and releasing the first fasteners to extend the lower curtain to the full length, wherein the first fasteners comprise a plurality of tack seals.

2. A method as defined in claim 1 wherein the upper curtain includes second fasteners and wherein connecting the lower curtain to the upper curtain comprises securing the second fasteners into corresponding holes defined in the lower curtain.

3. A method as defined in claim 2 wherein securing the second fasteners into corresponding holes in the lower curtain comprises securing at least one of the second fasteners having a hook and a free end through a corresponding one of the holes to lock the lower curtain to the upper curtain, both of the hook and the free end extending through the corresponding one of the holes.

4. A method as defined in claim 1 wherein connecting the lower curtain to the upper curtain comprises:

withdrawing a portion of the lower curtain from a bag containing the lower curtain; and securing a portion of an upper gusset of the lower curtain to the upper curtain without completely extracting the lower curtain from the bag such that the lower curtain does not contact a floor when connecting the lower curtain to the upper curtain.

5. A method as defined in claim 1 wherein the upper curtain comprises a washable mesh curtain and the lower curtain comprises a disposable plastic curtain.

6. A method as defined in claim 1 wherein releasing the first fasteners to extend the lower curtain to the full length comprises releasing the tack seals.

7. A method as defined in claim 1 wherein connecting the lower curtain to the upper curtain is performed by a first person and releasing the first fasteners to extend the lower curtain to the full length is performed by a second person.

8. A method as defined in claim 1 wherein connecting the lower curtain to the upper curtain such that the lower curtain is suspended from the upper curtain with the lower portion of the lower curtain folded back on and secured to the lower curtain to prevent the lower curtain from extending to the full length provides a visual indication that the lower curtain is a new lower curtain.

9. A method as defined in claim 1 wherein releasing the first fasteners to extend the lower curtain to the full length is not performed until a time to use the lower curtain arrives.

10. A method as defined in claim 1 wherein the lower curtain comprises a disposable hospital curtain or a disposable shower curtain.

11. A method as defined in claim 1 wherein the first fasteners hold the lower curtain in a substantially inoperative position after installation to provide a visual indication that the lower curtain is new.

* * * * *